US010231551B2

(12) United States Patent
Lehoux

(10) Patent No.: US 10,231,551 B2
(45) Date of Patent: Mar. 19, 2019

(54) HEATED SITTING SURFACE

(71) Applicant: DESIGNER MARIO LEHOUX INC., Montreal (CA)

(72) Inventor: Mario Lehoux, Montreal (CA)

(73) Assignee: DESIGNER MARIO LEHOUX INC., Montreal, QC (CA)

( * ) Notice: Subject to any disclaimer, the term of this patent is extended or adjusted under 35 U.S.C. 154(b) by 0 days.

(21) Appl. No.: 15/901,884

(22) Filed: Feb. 21, 2018

(65) Prior Publication Data

US 2018/0242748 A1 Aug. 30, 2018

Related U.S. Application Data

(60) Provisional application No. 62/461,264, filed on Feb. 21, 2017.

(51) Int. Cl.

| | |
|---|---|
| ***A47C 7/74*** | (2006.01) |
| ***A47C 11/00*** | (2006.01) |
| ***E04H 1/12*** | (2006.01) |
| ***G09F 13/00*** | (2006.01) |
| ***H05B 1/02*** | (2006.01) |

(52) U.S. Cl.

CPC ..... *A47C 7/748* (2013.01); *A47C 11/00* (2013.01); *E04H 1/1211* (2013.01); *G09F 13/00* (2013.01); *H05B 1/0277* (2013.01)

(58) Field of Classification Search

CPC ..... A47C 7/748; A47C 11/00; E04H 1/1211; G09F 13/00; H05B 1/0277

USPC ..... 52/36.1, 73, 79.1

See application file for complete search history.

(56) References Cited

U.S. PATENT DOCUMENTS

| | | | | | |
|---|---|---|---|---|---|
| 4,491,721 | A * | 1/1985 | Davis | A47C 21/048 | 219/217 |
| 5,107,637 | A * | 4/1992 | Robbins | E04H 1/1211 | 136/291 |
| 5,229,579 | A * | 7/1993 | Ingraham | B60H 1/2218 | 219/202 |
| 5,363,608 | A * | 11/1994 | Conlan | E04H 1/1211 | 52/66 |
| 5,802,479 | A * | 9/1998 | Kithil | B60N 2/002 | 257/295 |
| D754,362 | S * | 4/2016 | Indio da Costa | D25/1 | |
| 9,703,320 | B2 * | 7/2017 | Bowers | G06F 1/1601 | |
| 9,909,272 | B2 * | 3/2018 | Lancelot | E01F 1/00 | |
| 2005/0072060 | A1 * | 4/2005 | Moncho | E04H 1/1211 | 52/79.1 |
| 2008/0142494 | A1 * | 6/2008 | Blake | B60N 2/5685 | 219/217 |
| 2008/0215907 | A1 * | 9/2008 | Wilson | G06F 1/08 | 713/500 |
| 2009/0064411 | A1 * | 3/2009 | Marquette | A47C 21/044 | 5/423 |
| 2010/0050541 | A1 * | 3/2010 | Bright | E04H 1/1211 | 52/73 |

(Continued)

*Primary Examiner* — Joshua K Ihezie

(74) *Attorney, Agent, or Firm* — Anglehart et al.

(57) ABSTRACT

Provided is technology suitable for public environments, such as sites serving transportation networks such as bus shelters and train stations, parks, public venues, stadiums, arenas, interior or exterior environment. The technology described herein provides a heated sitting surface. Moreover the present technology allows the production of new heated sitting surfaces.

11 Claims, 8 Drawing Sheets

(56) References Cited

U.S. PATENT DOCUMENTS

| | | | | |
|---|---|---|---|---|
| 2011/0058326 | A1* | 3/2011 | Idems | G09F 9/30 361/679.21 |
| 2011/0307148 | A1* | 12/2011 | Griffin | B60N 2/002 701/45 |
| 2012/0112501 | A1* | 5/2012 | Estes | A47C 7/744 297/180.12 |
| 2012/0234815 | A1* | 9/2012 | Willey | B60N 2/5685 219/202 |
| 2014/0097651 | A1* | 4/2014 | Fortune | B60N 2/5685 297/180.12 |
| 2014/0284022 | A1* | 9/2014 | Maxbauer | B60H 1/2218 165/41 |
| 2015/0382403 | A1* | 12/2015 | Philip | H05B 3/145 219/213 |
| 2016/0294199 | A1* | 10/2016 | Poffinbarger, II | H02J 7/0027 |
| 2016/0304013 | A1* | 10/2016 | Wolas | B60N 2/5628 |
| 2017/0028864 | A1* | 2/2017 | Gerhold | B60L 11/1838 |
| 2017/0172294 | A1* | 6/2017 | Gober | A47B 37/00 |
| 2017/0254034 | A1* | 9/2017 | Lancelot | E01F 1/00 |
| 2018/0022231 | A1* | 1/2018 | Bennett | G01V 3/08 |

* cited by examiner

HEATED SITTING SURFACE

The present patent application claims priority of U.S. provisional patent application Ser. No. 62/461,264 filed Feb. 21, 2017, the content of which is hereby incorporated by reference.

TECHNICAL FIELD

The present invention relates to the field sitting surfaces such as benches as may be found in public environment and more particularly the present invention relates to the field of heated seating surfaces. The present invention also relates to bus/transit system shelters.

BACKGROUND

Sitting surfaces are commonly provided for the public, e.g. in the form of public benches, particularly in areas of high pedestrian traffic and in places where members of the public are likely to be waiting or sitting for long periods of time. For example, public benches are likely to be found outside of airport terminals, in bus shelters or otherwise nearby bus stops and on train station platforms. Likewise in sports stadiums and other arenas, sitting surfaces are provided for fans and players alike.

When the ambient temperature is cold, it can be uncomfortable to sit for any length of time. For one, the mere act of sitting reduces the effort made compared to standing or walking, which over time can reduce the heat generated by the body. Moreover oftentimes public sitting surfaces are made of tough materials such as metals which often have a high thermal conductivity and/or a large thermal mass thus allowing the sitter's body heat to transfer to the bench quickly and/or persistently leading to the sitter feeling cold.

In certain cases attempts have been made to provide sitter comfort by providing an air heater in proximity to public benches located in a transit shelter. FIGS. 1 and 2 illustrate and examples of a set of public benches installed by the transit authority of a major city. In this example, perforated stainless steel benches are installed over electric space heaters all inside a closed transit shelter with closed doors. Such heaters are intended for use in a fairly closed environment to heat the air therein. In the context shown here, these heaters would require an air tight transit shelter to be effective, which is fairly expensive to implement and impractical or impossible in certain locations. Moreover closed shelters provide more for vandals to destroy. Even in a closed shelter, space heaters mainly heat the air, the sitting surface remaining barely warm when the exterior temperature is cold. Air that was warmed by such a system is liable to escape whenever a door is opened, leading to wasted energy and a cold sitting area. Lastly, the heating elements in such installations are on and active constantly during the cold season, even when no users are present, leading to uselessly wasted energy.

Even in certain indoor conditions, a sitting surface can feel cold. This is often true in areas that are not very well heated, or in places where people are likely to sit shortly after coming in from a cold setting (e.g. the exterior, in cold places) while still feeling cold from their previous setting.

Other related technologies include heated car seats. However, heated car seats are not suitable for outdoor use or for public use, not only because of their non-robust, non-weatherproof construction but also because they rely on a manual on/off/dimmer switch which may be unsuitable for such use.

In cold climates, transit shelters located at bus and train stops are commonplace. For reliability and for reducing damage due to vandalism, such shelters have no door. A resistant bench or seats are provided, and the shelter provides protection from the wind. It is common to provide signage in the shelter. It is known to provide heating in such shelters, however, due to the open doorway, efficiency is poor.

SUMMARY

Applicant has found that comfort in a transit shelter can be greatly improved by providing heated seats or a heated bench using low power consumption. Control over the heated sitting surface can be by timer or presence sensor. Control over heating can also include an ambient temperature sensor so that heating is only applied when ambient temperature is cold. The heating can also be increased when ambient temperature is colder than a predetermined temperature.

Provided is a novel and inventive solution borne of multiple surprising discoveries and years of rigorous development and testing which provides a heated seating unit that is robust and energy-efficient, suitable for outdoor use, vandal-resistant, and comfortable for users.

In some embodiments, there is provided a heated seating unit comprising a sitting surface, an electronic controller connectable to be powered by a power source, a heating element mounted to or near the sitting surface and controlled by the electronic controller, a use detector for detecting the presence of a body on the sitting surface, the use detector being in communication with the electronic controller to provide thereto a signal indicative of whether the presence of a body is detected on the sitting surface. The electronic controller regulates a change of state between a sleep mode wherein the heating element is turned off and a heating mode wherein the heating element is turned on at least in part on the basis of the signal received from the use detector.

The heated seating unit can be converted from a conventional bench.

BRIEF DESCRIPTION OF THE DRAWINGS

The invention will be better understood by way of the following detailed description of embodiments of the invention with reference to the appended drawings, in which:

FIG. 5A is a schematic block diagram of the controller according to a first option in which the sitting surface is heated continuously when the temperature is below 5 degrees Celsius;

FIG. 5B is a schematic block diagram of the controller according to a second option in which the sitting surface is heated according to a time schedule when the temperature is below 5 degrees Celsius;

DETAILED DESCRIPTION

Provided is technology suitable for public environments, such as sites serving transportation networks such as bus shelters and train stations, parks, public venues, stadiums, arenas, interior or exterior environment.

The technology described herein provides a heated sitting surface. Moreover the present technology allows the production of new heated sitting surfaces as part of a new line of exterior benches.

Figure 1:
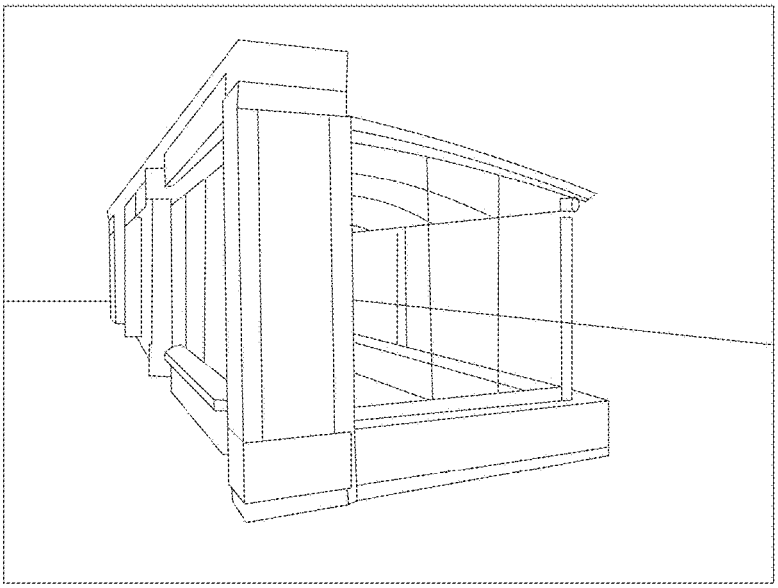
Figure 1 A (Prior Art)
FIG. 1A is a picture of a prior-art transit shelter having a door.
FIG. 1B is a picture of a prior art transit shelter having a roof, transparent back wall, a signage wall and a bench.
FIG. 1C is a picture of a prior art transit shelter having a roof, three transparent wall panels, a signage wall, an entrance/exit opening and a bench.
Figure 1:
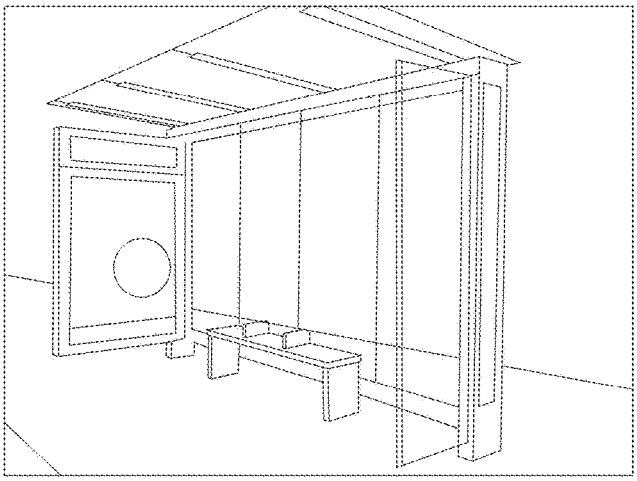
Figure 1 B (Prior Art)
Figure 1:
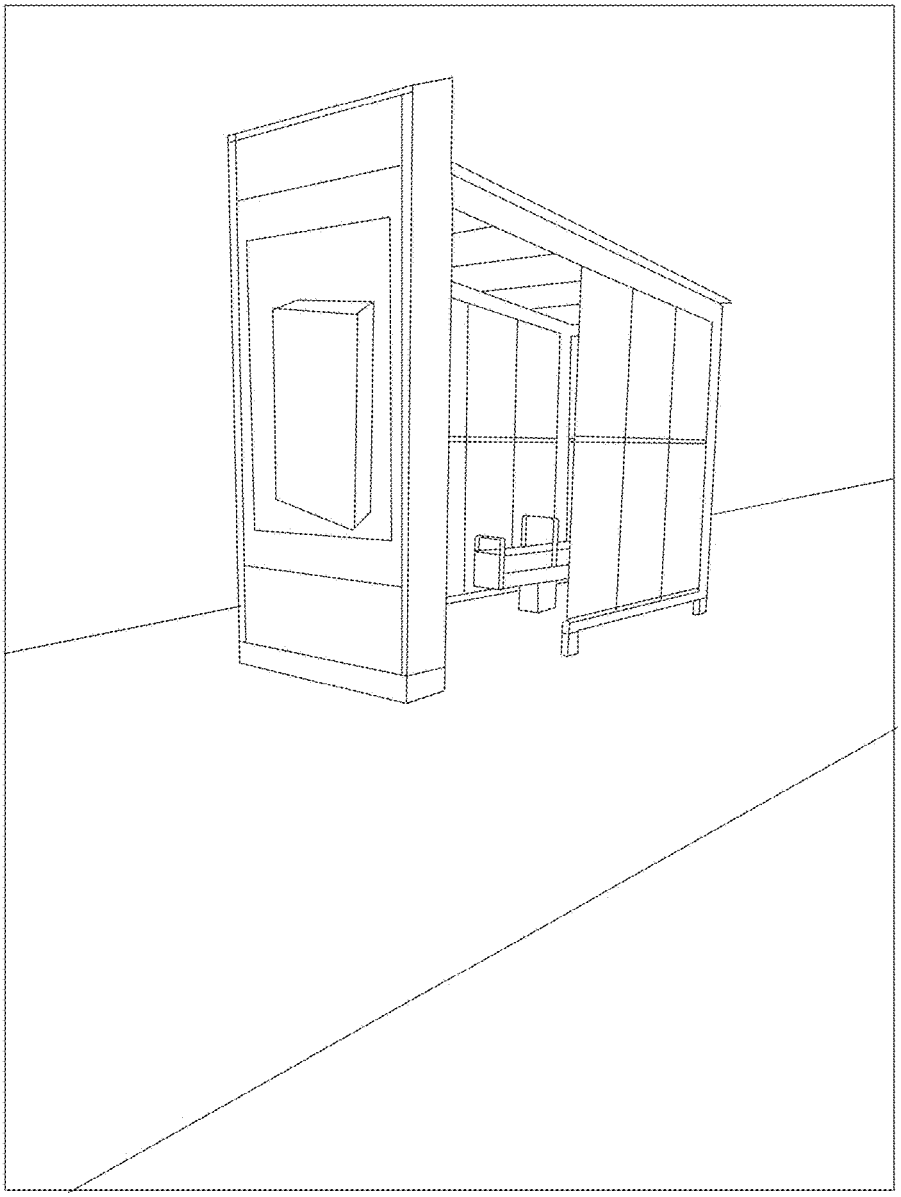
Figure 1 C (Prior Art)
Figure 2:
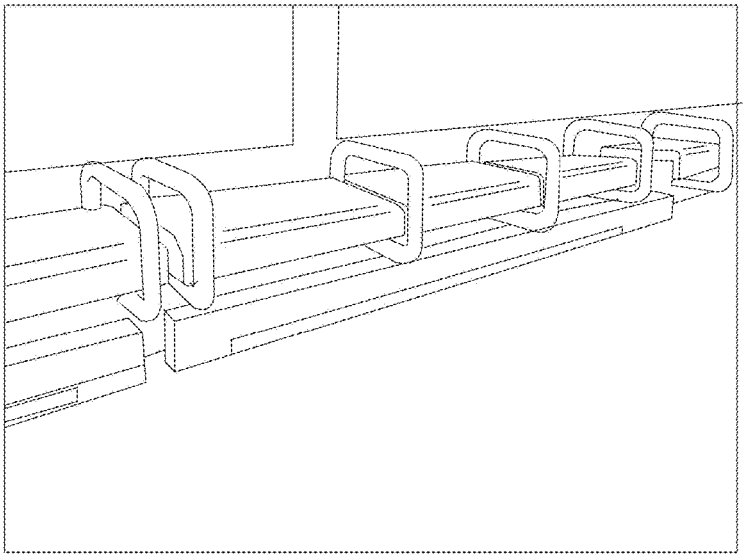
Figure 2 ( Prior Art)
FIG. 2 is a picture of the prior-art public bench of FIG. 1A in which heat is provided under the bench having a perforated metal surface.

A transit shelter can be a large enclosure with a door as shown in FIG. 1A, a smaller two wall and roof shelter as shown in FIG. 1B, or a four wall shelter with an entrance opening as shown in FIG. 1C. Signage can be integrated into a wall panel and can be illuminated as shown for advertising or transit schedule information display. Electrical power is often provided to such shelters.

The transit shelter can have transparent wall panels with an entrance exit opening such that the walls extend around three and a half sides to provide for better wind and rain shelter. A backlit sign can be provided on one end wall. The bench can be for two people or it can be expanded to receive more people. The shelter can be mounted to a cement or concrete pad. The entrance opening can face away from the curbside and the side wall containing signage can be provided on the upper part of the wall. The bench can be a two to three person bench with two dividers preventing sleeping on the bench. The bench surface as described above can be made of resilient plastic or stainless steel, namely a hard surface. In the case of a motion or presence sensor, it can be integrated on the wall with the signage rather than on the transparent walls to provide a more discrete integration.

Figure 3A:
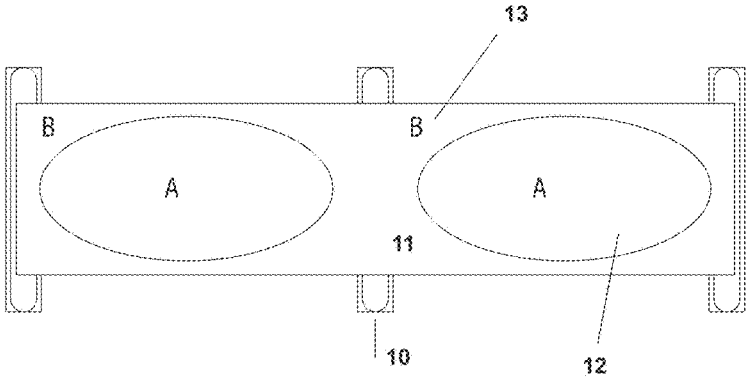
FIG. 3A is a plan view of seating surface showing sitting surfaces A and surrounding surface B.

The bench 10 according to one embodiment is illustrated in plan view in FIG. 3A. The bench surface 11 can be heated uniformly over its surface as shown in FIG. 3C or designated sitting surfaces 12 can be heated while surrounding areas 13 are not provided with full heat.

Figure 3B:
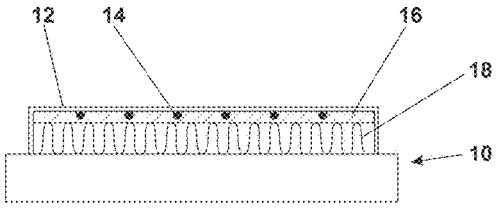
FIG. 3B is a side sectional view of seating surface.
Figure 3C:
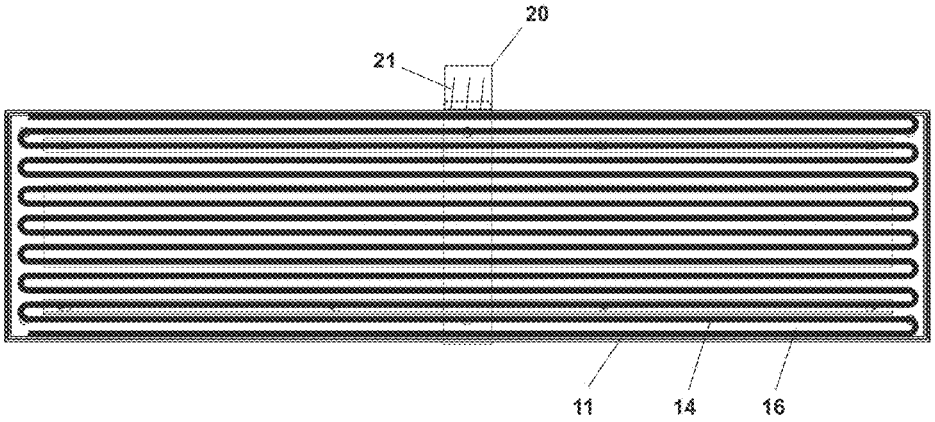
FIG. 3C is a plan sectional view of seating surface showing heating wire layout.
Figure 3D:
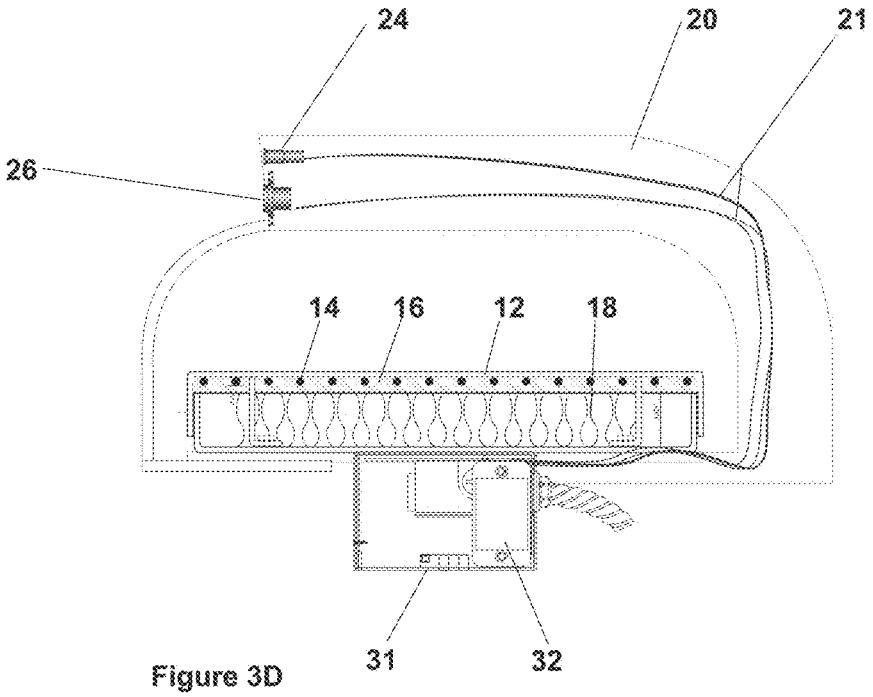
FIG. 3D is a sectional view of seating surface about armrest.
Figure 4A:
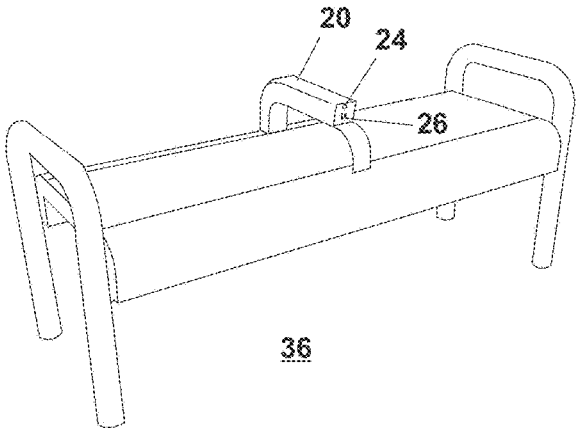
FIG. 4A is a perspective view of bench with LED lighting below bench.
Figure 4B:
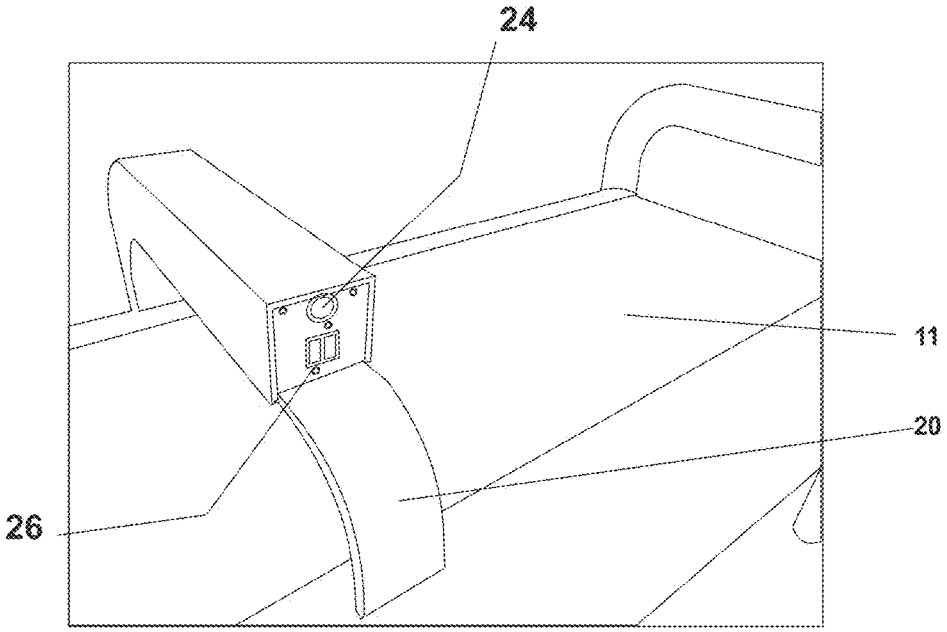
FIG. 4B is a detail of armrest with USB charging port, light and heated surface of bench.
Figure 6A:
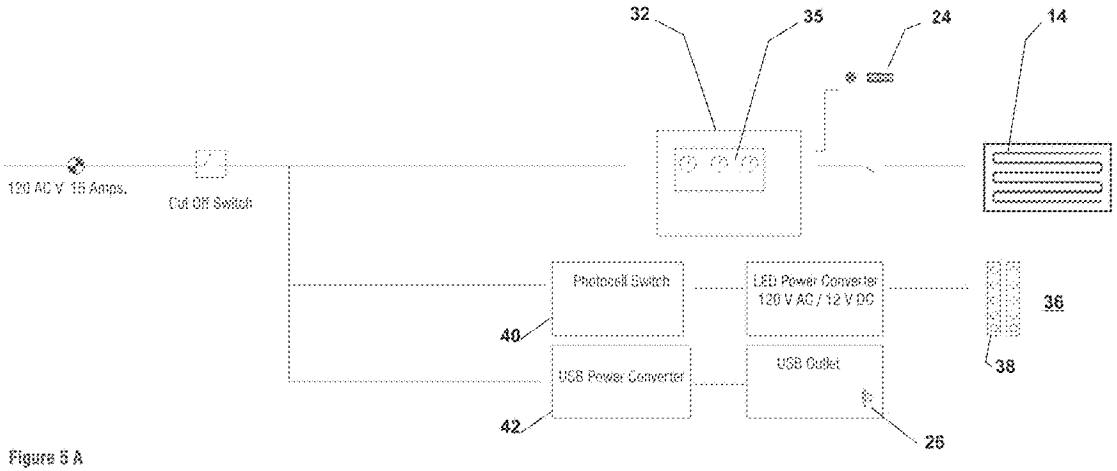
Figure 6B:
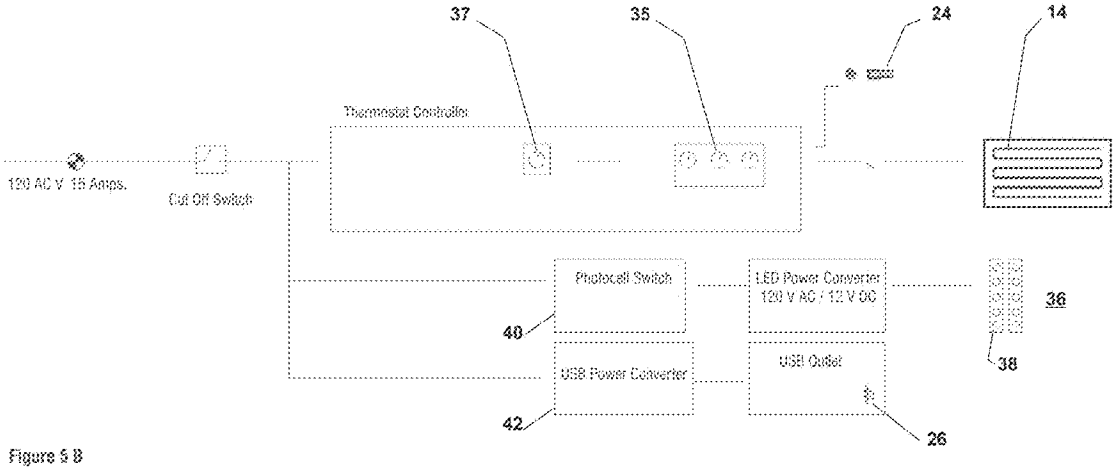

FIG. 3B illustrates a side section view of the bench or seating unit 10 of FIG. 3A in which the fire-retardant insulation 18 (Roxul™ or equivalent), heating wires 14 or Warming Wire (Wattswater product 120 VAC/11 ohms to 23 ohms/5.2 A to 10.33 A operating in outdoor/Ambient, 624 W to 1,240 W/52 FT to 62 FT heating wire) and (extending along the bottom of the sitting surface and held in place using Kerabond™/Keralstic™ premium flexible mortar system 16 between ⅜" to ⅝" thick) and stainless-steel (may be custom brushed) steal sitting surface 12 are shown, with the insulation 18 below the heating element 14. It will be appreciated that the sitting surface 12 can be made of plastic or other materials. In one embodiment, the bench 10 may have a sitting surface 11 between 10¾" to 12" width and ½" to ½" height with the heating wires 14 having a distance between 0'-1¼" (¾" final assembly), a premium flexible mortar system 16 having a thickness of ⅜" to ¾" (⅜ final assembly). FIG. 3C illustrates a plan sectional view of a bench 10 having heating wires 14 covering the entire bench surface. FIG. 3D is a sectional view of an armrest 20 for a bench 10 that shows the bench surface 12, its insulation 18 and heating wires 14, with the controller 32 contained in a box 31 below the bench with wires 21 passing in the armrest for a light 24 with an active and passive mode and mobile device charging port 26 as illustrated in the detail view of FIG. 4B. FIG. 4A is a perspective view of the bench illustrated in FIGS. 3A to 3D having a lit area 36 below the bench 10.

The electronic controller 32 can provide various levels of control. In FIG. 5A, only a thermostat controller 35 is provided in the controller 35 to control heating only when the ambient temperature drops below a predetermined temperature, for example between 0 and 10 degrees Celsius. When the outside temperature is very cold, the heated sitting surface may only remain a few degrees above the ambient temperature, however, when a person sits and covers the sitting area, the temperature may rise to be comfortable. A thermostat (not shown here) in the sitting surface 11 may also be used to ensure that the temperature does not exceed a comfort level. Tests have shown that a comfort level is near body temperature and as a little as two degrees above body temperature can be perceived as uncomfortable, while as little as four degrees Celsius below body temperature can be perceived as too cold. Tests have also shown that providing the warmth from the sitting surface 11 makes waiting for the bus or train to arrive much more comfortable when in an otherwise unheated shelter, provided the user is otherwise relatively well dressed for the cold weather. The small amount of heat and the protection from wind chill are effective.

When the exterior temperature is below 5 C or less, the controller 32 activates the heating surface 12. The controller 32 will provide/control the following: a minimum of 37 C in region A or B; and a maximum of 42 C in region A or B.

In the embodiment of FIG. 5B, the controller 32 includes a time of day clock 37 (in one embodiment, time clock, battery activated—10 year lifetime—offline 1 h00 am to 5 h00 am) and the controller 32 is programmed to provide heating only according to the programmed schedule, for example, to be off from 1 AM to 5 AM. In FIG. 5B, the ambient temperature sensor is used in conjunction with the time of day control.

Figure 5C:
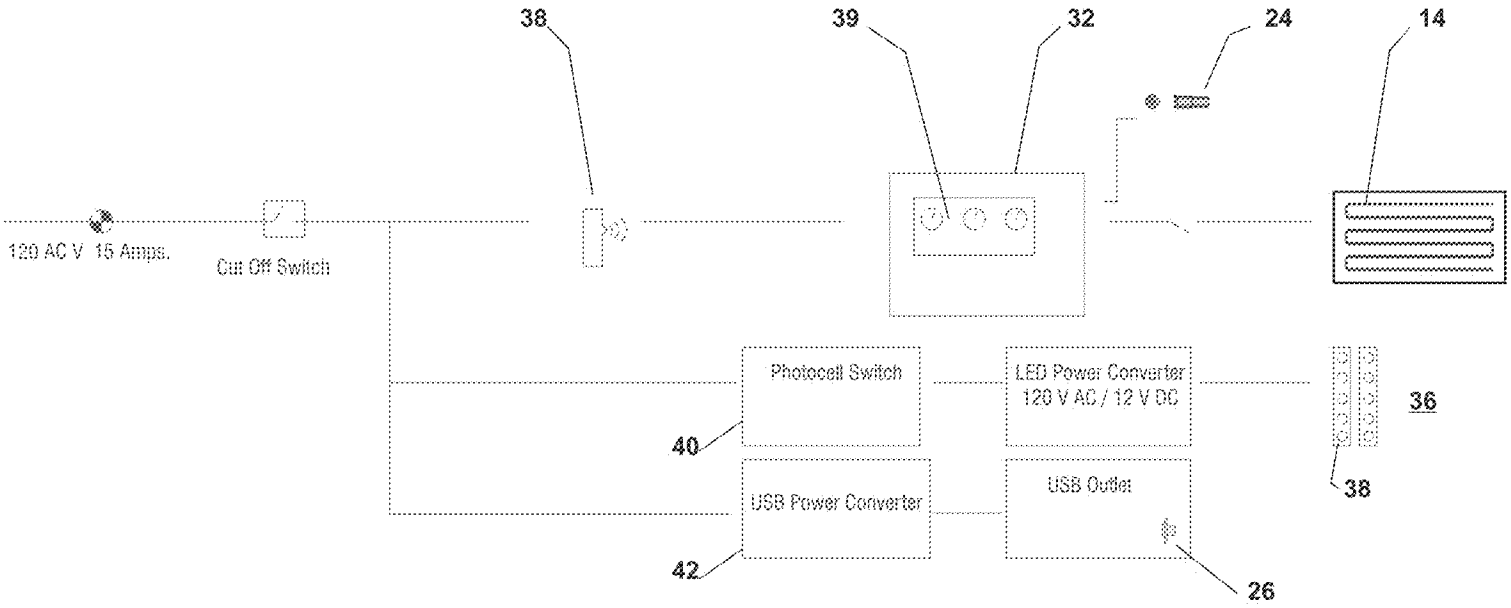
FIG. 5C is a schematic block diagram of the controller according to a third option in which the sitting surface is heated for a period of time following detection of occupancy and when the temperature is below 5 degrees Celsius.

In the embodiment of FIG. 5C, the controller 32 further includes a sensor 38 such as a touchless motion sensor for detecting occupation of the shelter or of a person sitting on the bench or chair.

In accordance with one particular example, a heated seating unit 10 is powered by 120V AC and is self-managed by an electronic controller 32. In a preferred embodiment, the seating unit implements a sleep mode in certain conditions to save energy. In one such embodiment, the seating unit comprises one or more use sensors in communication with the electronic controller 32 that detect when the seating unit 10 is being used and provide an output signal to the electronic controller 32 indicative of seating unit use and/or non-use. The electronic controller receives this signal as an input and causes the seating unit to enter a sleep mode while not being used. More specifically, the electronic controller 32 may implement algorithmic rules to determine when to enter a sleep mode as a function of at least the input from the use sensor and causes the seating unit 10 to enter sleep mode when these rules are met. Likewise, the algorithmic controller may implement algorithmic rules to determine when to exit sleep mode and start or resume seat heating also as a function of the input from the use sensor. The electronic controller 32 causes the seating unit 10 to exit sleep mode and to enter a heating mode when these rules are met.

The seating unit is caused to enter sleep mode by the deactivation by the electronic controller of the heating element. The seating unit is caused to enter heating mode by the activation by the electronic controller of the heating element.

In one embodiment, the use sensor comprises a touchless motion detector 38. The touchless motion detector 38 is mounted to the seating unit 10 in proximity to the sitting surface 11 so as to detect the presence of a body on the sitting surface 11. In one example of sleep mode/heating mode rules, the electronic controller 32 causes the seating unit 10 to enter heating mode immediately upon detection of a body on the sitting surface and remains in heating mode for a predetermined length of time (e.g. 30 minutes). To that end, a timer counts to the predetermined length of time. At every re-triggering of the use sensor, the timer restarts the counter. The controller 32 causes the seating unit to enter sleep mode when the timer reaches the predetermined length of time with nobody being detected on the sitting surface. Other algorithmic rules determining when to enter sleep/heating modes can be established as a function of other criteria. For example, the electronic controller 32 could omit re-starting the counter whenever motion is detected, re-entering heating mode only upon use detection after expiry of the counter period. That way, if a person sits only for 15 minutes (assuming an exemplary timer period of 30 minutes), sleep mode would be entered another 15 minutes later, rather than 30 minutes later. Alternatively, the electronic controller could enter sleep mode immediately upon detecting no use and enter heating mode immediately upon detecting use.

By the implementation of the sleep and heating modes, the seating unit benefits of a lowered energy consumption.

Security Lights: In certain embodiments, such as for certain implementations of seating units for transit shelters, the seating unit is provided with LED lights 38 to provide ambient lights, and/or to provide visual cues as to the location of the seating unit 10, both of which can be useful in low-light situations. In an exemplary implementation, the LED lights may be mounted generally down-facing, e.g. to an underside of the sitting surface 11 or to another surface of the seating unit. In one embodiment, the bench 10 has two light LED bars glowing down from under the sitting area and illumination area 36. The LED lights 38 are in electrical communication with the electronic controller 32 which controls the LED lights 38 to activate and deactivate them. In a preferred embodiment, the seating unit 10 further comprises light sensor hardware, such as one or more photocell sensor or photocell switch 40, in communication with the electronic controller. The electronic controller receives input from the light sensor hardware 40 indicative of a level of ambient light. Similarly, to with the use sensor, the electronic controller 32 receives this signal as an input and causes the seating unit to enter a daytime mode when the photocell sensor detects an ambient light above a certain threshold. Other algorithmic rules to determine when to enter the daytime mode may be implemented as a function of additional criteria (e.g. time of day) and/or to control other elements of the seating unit. For example, a guiding light may be turned off when the use sensor detects a body on the sitting surface. Likewise, the algorithmic controller may implement algorithmic rules to determine when to enter a night mode also as a function of the input from the light sensor hardware. In the present embodiment, the electronic controller causes the seating unit to enter the night mode when the photocell sensor 40 detects an ambient light below the certain thresholds. Again, other algorithmic rules may be implemented as a function of other criteria and/or to control other elements of the seating unit. For example, a mood light may be activated when the use sensor detects the presence of a body on the sitting area. In the present example, a single set of LED lights 38 is provided which are turned off in the daytime mode and turned on in the night mode.

By the implementation of the daytime and night modes, the seating unit benefits of a lowered energy consumption.

In a preferred embodiment, the seating unit also comprises a USB port 26 powered by the seating unit's energy source via a USB power converter 42 (in one embodiment, 120V AC/12 V DC) provided on the seating unit 10. This adds to the convenience of the seating unit as users may use the USB port to power or charge their USB electronics such as phones or other devices.

Advantageously, the seating unit may be constructed using existing components and off-the-shelf components arranged in the inventive assembly to which is added the novel and inventive electronic controller.

Likewise, the inventive technology also provides for the conversion of existing sitting areas, benches and the like into the present seating unit. As such public settings such as transportation areas, parks public venues stadiums arenas, and other interior and exterior environments may be provided with the inventive seating unit via a conversion process.

Advantageously, the present invention allows existing solid benches to be used or new sitting surfaces to be provided to create a robust, vandal-proof unit that provides little or no accessible target for vandalism and little or no visible elements to tempt vandals.

As described above, in order not to waste energy, the heated surface may be active only when triggered by a motion detector. The motion detector can be, for example, a passive infrared motion detector or an active infrared proximity sensor, and it can be mounted to the frame of the transit shelter to detect presence in the shelter or more specifically in the sitting area. Once activated, the heated surface is active for a certain duration. If retriggered, then the heated surface stays on until there is no more motion in specific surface of the sitting area. At the end of that time cycle, when no more motion can be detected, then the heated surface goes in sleep mode until it is retriggered.

In a preferred embodiment, the seating unit further comprises an ambient temperature sensor in communication with the electronic controller which provides an output to the electronic controller indicative of the ambient temperature. The ambient temperature can be the temperature outside of the shelter or inside the shelter. The electronic controller receives this output as an input and further implements an additional rule preventing the seating unit from entering heating mode when the ambient temperature is above a particular temperature threshold, which in the present example is 0° C., although a higher threshold of about 5° C. to 10° C. is possible. At 0° C. or lower, the heating mode is enabled, provided that the other algorithmic rules are met (namely, that the use sensor detect a body on the sitting surface, or that the timer period has not expired since the last detection). At 1° C. and above, however, the seating unit remains in sleep mode regardless of the input from the use sensors. This too provides the seating unit with the benefit of lowered power consumption. Because the heated seat is protected from wind, rain and snow, it has been found that a two to four person bench in a transit shelter can be kept warm (about 35 degrees Celsius) with a continuous power consumption as follows: Exterior temperature −5 C, electrical consumption is 0.18 kW/h, Exterior temperature −15 C, electrical consumption is 0.35 kW/h. These electrical data were gathered under the following, no wind, no snow, no ice rain, no rain. All weather conditions did have a direct impact on electrical data. Maximum electrical power of the system is 12.81 W/linear ft, 0.756 kW/h.

The heating elements apply heat directly to the sitting surface, which is then transferred to the sitter. This makes the present system suitable for exterior environments and does not require an air tight enclosure. The present implementation is robust and can be provided outside in places exposed to the outdoors and exterior weather. Even out in the open, the sitting surface can reach comfortable temperatures and dry off snow and rain. Having the heated surface used on a transit shelter bench is time saving as no rain or snow prevents the user from sitting down while waiting for its bus to arrive.

Through surprising discoveries and rigorous testing and development, the inventive combination and arrangements of materials, components, installation dimensions all detailed in FIGS. 3-6, and the inventive electronic controller, have been found to provide an excellent solution in the seating unit which provides substantial benefits over the prior art. Among other things, identifying the source of heat and configuration, the insulation material and configuration, the layout of all the materials and their combination as assembled has involved considerable inventive activity.

It will be noted that the heating elements may be installed on the underside of the sitting unit on the "ceiling" and that beneath the heating element is provided an effective layer of insulation.

Moreover, the seating unit may comprise a thermostat sensor which shuts off the heating element when it reaches a predetermined threshold (e.g. 37° C., or alternatively, 42° C., for example).

In the present implementation, the seating unit has two seats, each being of which may be provided with respective thermostat sensors. The power is turned off to both when either reaches a predetermined temperature (e.g. 37 degrees; in another embodiment, 42° C.). It should be appreciated that the seating unit may be provided with a single seat or with more than two seats. Moreover, multiple seating units may be combined together to form a larger heated seating array.

In the present implementation, there is a use sensor for each of the seats, each being configured to detect the presence of a body on a respective seat. In this example, the electronic controller has a single sleep mode and a single heating mode for both seats, turning on both seats as a function of a detection of a body on either one (or, of course, both) of the seats. In an alternative embodiment, however, the electronic controller may have separate states for each seat, each state altering between sleep and heating mode in any manner described herein.

Likewise, in the present embodiment, a single light circuit is provided for the seating unit, however in alternative embodiment different sets of lights on separate circuits may be provided for each seat with the controller implementing a different status (e.g. operating between daytime and night mode as described herein) for each seat.

In the preferred embodiment, the seating unit comprises the following feature (inter alia):

energy management provided by the electronic controller;

the seating unit as described provides comfortable sitting temperature (between 37 C and 42 C) no matter the exterior weather conditions;

no energy wasted; and can be constructed as a new seating unit.

Also provided is a method of heating a seating unit comprising applying the algorithmic rules described herein to seating unit components.

Variants within the reach of a person of ordinary skill in the art are hereby provided as well. The above description has been provided for the purpose of illustrating, not limiting the invention which is defined by the appended claims.

The invention claimed is:

1. A transit shelter comprising:

a frame structure mountable to a ground surface including at least one wall panel, a roof and an opening for entering and exiting the frame structure;

a bench or a plurality of seats mountable to the ground surface and having a hard sitting surface;

an electrical heating element integrated into said bench or seats for warming said sitting surface, said electrical heating element placed under said hard sitting surface;

insulation material placed under said electrical heating element;

a controller connectable to a power source and to said heating element for applying or removing heat from said sitting surface using at least an ambient temperature signal, said controller is operative to maintain said sitting surface at a temperature between 35 degrees Celsius and 43 degrees Celsius.

2. The shelter as claimed in claim 1, wherein at least one of said wall panels comprises an illuminated sign having a power input for receiving power from a power mains, said controller connectable to said power mains as said power source.

3. The shelter as claimed in claim 1, further comprising an ambient temperature sensor generating said ambient temperature signal, wherein said controller is operative to provide heat to said sitting surface only when said ambient temperature is below about 8 degrees Celsius.

4. The shelter as claimed in claim 1, further comprising a clock circuit generating said time of day signal, wherein said controller is operative to provide heat to said sitting surface only during predetermined times of day.

5. The shelter as claimed in claim 1, further comprising an occupant presence detector generating an occupant presence detection signal when an occupant is on or near said sitting surface, wherein said controller is operative to provide heat to said hard sitting surface only when said an occupant is on or near said sitting surface.

6. The shelter as claimed in claim 5, wherein at least one of said wall panels comprises an illuminated sign, said occupant presence detector being integrated in said one of said wall panels comprising said illuminated sign.

7. The shelter as claimed in claim 6, wherein said frame structure comprises two or more wall panels.

8. The shelter as claimed in claim 7, wherein at least some of said wall panels are transparent.

9. The shelter as claimed in claim 1, wherein said hard sitting surface is made of stainless steel.

10. The shelter as claimed in claim 1, wherein said controller further applies or removes heat from said hard sitting surface using a time of day signal.

11. The shelter as claimed in claim 1, wherein said controller further applies or removes heat from said hard sitting surface using an occupant detection signal.

* * * * *